United States Patent [19]

Pfender

[11] 4,367,776

[45] Jan. 11, 1983

[54] MACHINE FOR THE MANUFACTURE OF REINFORCING BODIES FOR PRECAST CONCRETE PARTS

[75] Inventor: Georg Pfender, Kisslegg, Fed. Rep. of Germany

[73] Assignee: MBK Maschinenbau GmbH, Kisslegg, Fed. Rep. of Germany

[21] Appl. No.: 199,736

[22] Filed: Oct. 23, 1980

[30] Foreign Application Priority Data

Nov. 10, 1979 [DE] Fed. Rep. of Germany ..... 2945556

[51] Int. Cl.[3] ..... B21F 27/10

[52] U.S. Cl. ..... 140/112; 219/56; 269/235; 269/238

[58] Field of Search ..... 140/51, 112; 219/56, 219/58; 72/422; 269/152, 235, 238; 414/14, 16

[56] References Cited

U.S. PATENT DOCUMENTS 2,380,990 8/1945 Paul ..... 269/238

FOREIGN PATENT DOCUMENTS 47028 10/1956 Fed. Rep. of Germany ..... 72/422

894798 4/1962 United Kingdom ..... 219/56

*Primary Examiner*—Lowell A. Larson

*Attorney, Agent, or Firm*—Amster, Rothstein & Engelberg

[57] ABSTRACT

A machine for the manufacture of reinforcing bodies for concrete pipes and the like, which comprises longitudinal bars and wire wound about the longitudinal bars. Two coaxial discs are provided. A main disc, fixedly mounted on a base frame, carries radially displaceable guide pieces for the longitudinal bars. A support disc, mounted on a carriage movable in the direction of the axis of the main disc, carries a clamping device for clamping the ends of the longitudinal bars at a selectively different spacing from the axis of the disc. The clamping device comprises elongate clamping members which constitute radially extending clamping slits. The clamping slits open and close in parallel over their entire length. The length and position of the clamping members correspond to the range of adjustment of the guide pieces on the main disc.

3 Claims, 4 Drawing Figures

MACHINE FOR THE MANUFACTURE OF REINFORCING BODIES FOR PRECAST CONCRETE PARTS

Figure 1:
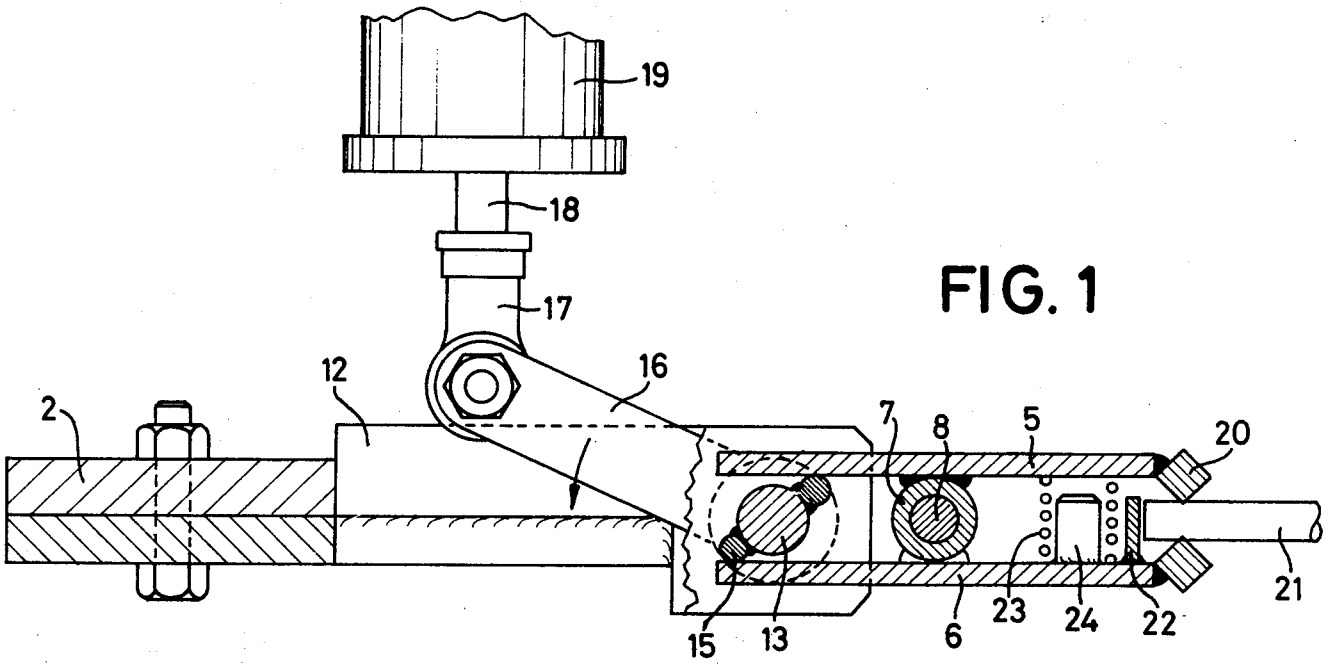

The invention relates to a machine for the manufacture of reinforcing bodies for concrete parts, especially pipes, the reinforcing bodies consisting of longitudinal bars and of wires which are wound over these bars and are welded thereto at the points of intersection, with the following features: there is provided a main disc mounted fixedly on a base frame. This main disc carries radially displaceable guide pieces for the longitudinal bars. A support disc is mounted, coaxially to the main disc, on a carriage which is movable in the direction of the axis of the main disc. This support disc carries a clamping device for clamping the ends of the longitudinal bars at a selectively different spacing from the disc axis.

From German Offenlegungsschrift No. 2,008,094 it is known with such a machine to arrange pneumatically actuable clamping tongs on each of several brackets and to make these brackets radially displaceable and lockable.

This has the disadvantage that, when the machine is changed over to a reinforcing body of another diameter or of out-of-round cross-section, all the brackets have to be detached, adjusted and subsequently secured again. The length of time needed for this is especially burdensome when the changeover takes place frequently or even after every second reinforcing body has been made.

The object of the invention is to construct the clamping device on the support disc so that it is possible to transfer to a reinforcing body of another cross-section without loss of time.

This object is achieved according to the invention, starting from a machine of the abovementioned type, by the fact that the clamping device of the support disc comprises elongate clamping members which constitute radially running clamping slits and that their length and position correspond to the range of adjustment of the guide pieces on the main disc.

The clamping members therefore no longer need to be adjusted radially at all, since they do not clamp only at one point at a certain distance from the centre. Rather, the clamping slits open and close, preferably by means of pneumatic working cylinders, in parallel over their entire length. It is therefore unimportant at which point of the clamping slit the longitudinal wire is inserted.

Whereas, with the known device, a special drive cylinder was assigned to each individual clamping tong, it is proposed in a development of the invention that a common drive cylinder is interposed between movable clamping members which belong to two different clamping slits. The number of drive cylinders required is thus reduced to half. Also, this is possible only if, in contrast to the known device, the clamping members are mounted fixedly on the support disc.

Preferably, there are provided as clamping members two substantially flat strips which are connected to one another tiltably about an axle which runs in the longitudinal direction of the strips and there runs between the strips and parallel to this axle a cross-sectionally out-of-round spreader rod which is mounted rotatably and is provided with a rotary drive. Consequently, unlike the jaws of a vice, the strips do not have to withstand an unsymmetrical load which would result in a twisting, but the clamping force arises at the point where the clamping strip edges encounter the resistance of the inserted longitudinal bar.

Figure 2:
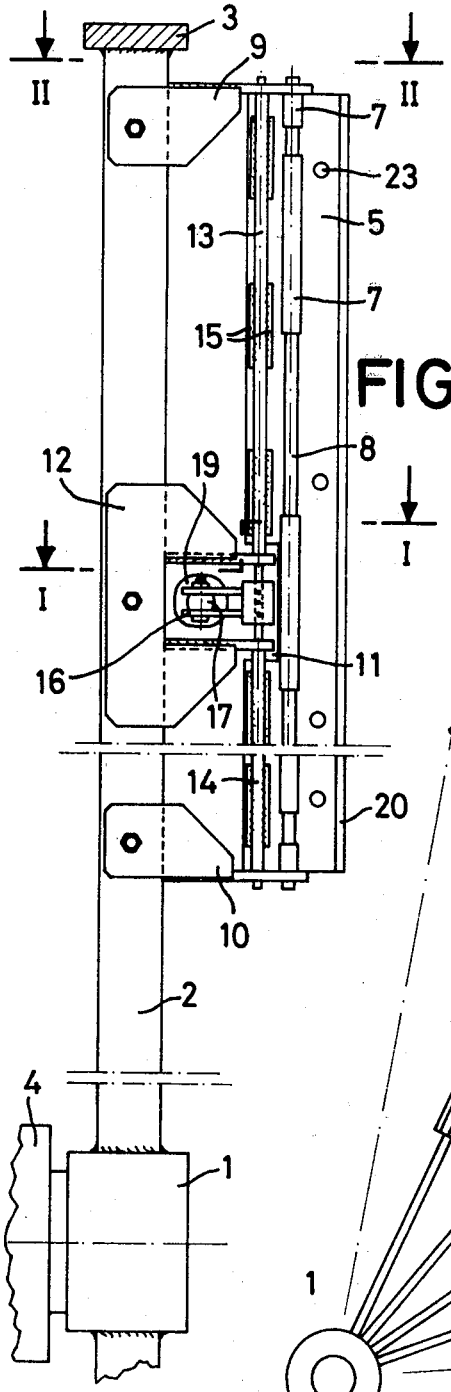
Figure 3:
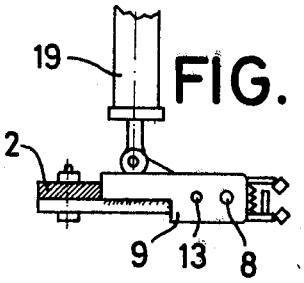
Figure 4:
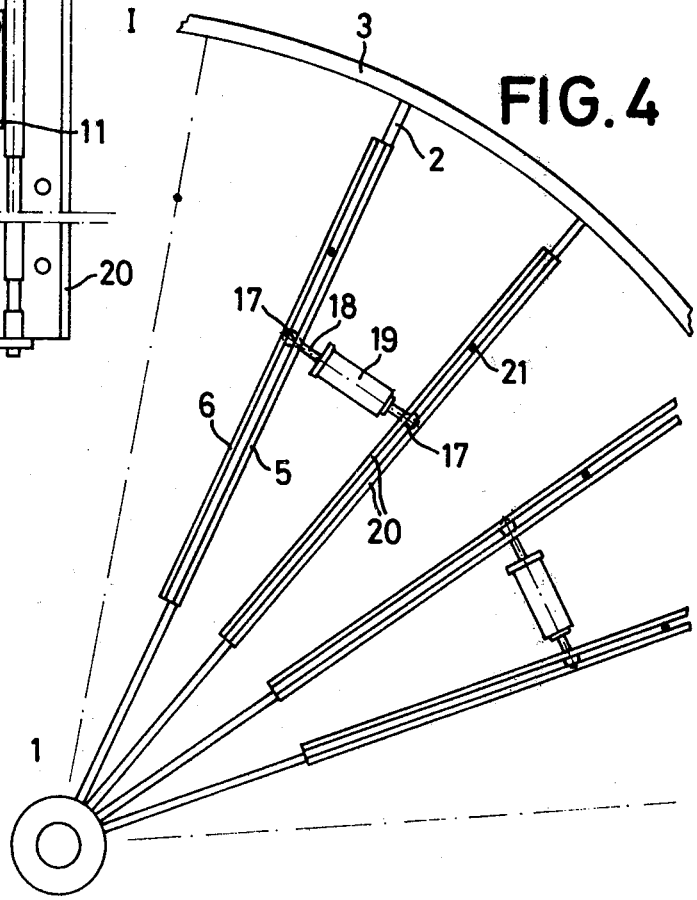

One exemplary embodiment of the invention is described in detail below with reference to the drawing wherein:

FIG. 1 is a cross-section I—I of the clamping device of a support disc designed as a spoked wheel, in virtually natural size, FIG. 2 is a side view of the device according to FIG. 1 corresponding to an axial section of the support disc, on a smaller scale, FIG. 3 is a section III—III of the device according to FIG. 2 and FIG. 4 is a view in the axial direction of a sector of the support disc, again on a smaller scale, The support disc consists, in this embodiment, of a wheel hub 1, twenty-four spokes 2 formed by flat bars directed in the axial plane and of an outer ring 3. The support disc is mounted with a horizontal axle in a carriage 4 (FIG. 2) which is movable on the base frame of the machine in an axial direction in relation to the coaxial, fixedly mounted main disc. The main disc is not shown. It is situated, according to FIG. 2, on the right-hand side of the support disc. The diameter of the discs is, approximately, between two and four meters in the case of conventional machines.

The clamping device comprises two flat clamping bars 5 and 6 which are mounted about a tilt axle 8 by means of bearing sleeves 7 which are welded to the clamping bars in alternating sequence, approximately along the longitudinal center line. The tilt axle 8 is mounted in an outer bracket 9 and an inner bracket 10, which are screwed to a spoke 2 in the vicinity of the outer ring 3 and radially further inwards respectively. The brackets 9 and 10 each consist of a bearing plate situated in a tangential plane and of a screw-on lug and hold the clamping bars 5 and 6 at a spacing from the spoke 2 and parallel thereto.

Approximately in the longitudinal centre the two clamping bars 5 and 6 each have a rectangular marginal cut-out 11. A double bracket 12 projects into this marginal cut-out with two rather shorter bearing plates. Between this double bracket 12 and the brackets 9 and 10 extend respectively spreader rods 13 and 14 parallel to the tilt axle 8 and, like the latter, approximately in the radial plane of the spoke 2. These spreader rods 13 and 14, also, are situated between the clamping bars 5 and 6. They are mounted rotatably in the brackets and have an out-of-round cross-section inasmuch as round iron pieces 15 are welded on lengthwise at points lying diametrically opposite one another. These round iron pieces are all situated in one plane. They fulfill the function of spreader cams and are distributed approximately regularly over the entire length of the clamping device. Within the double bracket 12 the projecting ends of the spreader rods 13 and 14 are fixedly connected to a drive lever 16 by means of pushed-through crosspins. The piston rod 18 of a pneumatic drive cylinder 19 is hinged between the parallel lever arms of this drive lever 16 by means of a ball-and-socket joint 17.

On the side remote from the support disc, cross-sectionally square edge strips 20 are welded onto the margins of the clamping bars 5 and 6, so that these strips stand opposite one another with one edge. These clamping edges constitute a clamping slit which receives the end of a longitudinal bar 21 of the reinforcing body to be manufactured. To ensure that the longitudinal bars can be inserted into all clamping devices by only a specifically short distance, a stop batten 22 is arranged on the inside of the clamping bar 6. Between this batten and the tilt axle 8 there are distributed over the entire length four compression springs 23 which endeavour to spread apart the clamping bars 5 and 6 on this side. The compression springs are held by means of journals 24 which are likewise fastened to the clamping bar 6.

As shown in FIG. 4, the clamping devices provided on each spoke of the support disc extend approximately over the outer two thirds of the disc radius. The reinforcing body winding machine on which the exemplary embodiment is based enables reinforcing bodies to be made, whose radii can lie in the abovementioned range. The guide pieces can be radially displaced on the associated main disc likewise within this range.

In the exemplary embodiment the pneumatic drive cylinders 19 are interposed respectively between two clamping devices lying next to one another. As shown in FIG. 1, the piston rod 18 is connected to the drive lever 16, whilst an attachment fastened to the cylinder housing is connected analogously and likewise via a ball-and-socket joint 17 to the mirror-image drive lever of the adjacent clamping device. If, therefore, during operation the piston rods 18 are moved out of the drive cylinders 19, the spreader rods 13 turn in the spreading direction, that is to say, according to FIG. 1, in the direction of the arrow, to the left. Consequently, the edge strips 20 situated on the other side of the tilt axles 8 are moved towards one another against the action of the compression springs 23 and clamp between themselves the longitudinal bars 21 which are inserted at any desired point within the clamping range.

Since fewer longitudinal bars are required for reinforcing bodies of smaller diameter than for those of large diameters, it may be appropriate to arrange on the individual spokes clamping devices of varying length, for example to provide two lengths in alternating sequence. In this case, it is advantageous if any two clamping devices of equal length are operated with one working cylinder. The one working cylinder passes across, in this case, behind the clamping strips lying therebetween. The cylinders belonging to different pairs of clamping devices do not disturb one another, since they have a radial spacing.

1. Wheel hub
2. Spoke
3. Outer ring
4. Carriage
5. Clamping bar
6. Clamping bar
7. Bearing sleeve
8. Tilt axle
9. Bracket
10. Bracket
11. Marginal cut-out
12. Double bracket
13. Spreader rod
14. Spreader rod
15. Round iron piece
16. Drive lever
17. Ball-and-socket joint
18. Piston rod
19. Drive cylinder
20. Edge strip
21. Longitudinal bar
22. Stop batten
23. Compression spring
24. Journal

I claim:

1. A machine for the manufacture of reinforcing bodies for precast concrete parts, including pipes, having longitudinal bars and wires wound over and welded at the points of intersection of the bars, comprising:

a base frame;

a main disc mounted fixedly on the base frame;

guide pieces for the longitudinal bars radially displaceable relative to and carried by the main disc;

a carriage displaceable relative to the axis of the main disc;

a support disc mounted on the carriage and coaxially relative to the main disc; and elongate clamping members carried by the support disc which constitute radially extending clamping slits, the length and position thereof corresponding to the range of adjustment of the guide pieces on the main disc, for clamping the ends of the longitudinal bars at a selectively different spacing from the axis of the support disc.

2. A machine according to claim 1, further comprising a common drive cylinder intersposed between clamping members which constitute two different clamping slits.

3. A machine according to claim 1, in which the clamping members comprises:

two substantially flat strips;

an axle which runs in the longitudinal direction of the strips, about which the strips are connected tiltably to each other; and a drivable cross-sectionally out-of-round spreader rod rotatably mounted between the strips and parallel to the axle.

* * * * *